United States Patent [19]

Defourneaux, Jr.

[11] 4,192,377

[45] Mar. 11, 1980

[54] BOTTOM VALVE TRIPPING AND LIQUID CHANNELING DEVICE FOR AN AUTOMATED BAILER OF SHALLOW WELLS

[76] Inventor: Robert P. Defourneaux, Jr., 800 Morse La., River Ridge, La. 70123

[21] Appl. No.: 955,844

[22] Filed: Oct. 30, 1978

[51] Int. Cl.[2] ..... E21B 33/03

[52] U.S. Cl. ..... 166/70; 137/874; 166/94

[58] Field of Search ..... 166/92, 94, 69, 70, 166/97, 75 R, 75 A, 107, 67; 137/874

[56] References Cited

U.S. PATENT DOCUMENTS

| | | | |
|---|---|---|---|
| 481,635 | 8/1892 | Maxfield | 137/874 |
| 1,275,166 | 8/1918 | Krippene | 137/874 |
| 3,472,317 | 10/1969 | Fowler | 166/75 X |
| 3,924,686 | 12/1975 | Arnold | 166/70 X |
| 4,037,662 | 7/1977 | Bowling | 166/311 |

*Primary Examiner*—William F. Pate, III
*Attorney, Agent, or Firm*—James B. Lake, Jr.

[57] ABSTRACT

A cylindrical body defines a through passage for a pipe bailer and its contents, and a side exit for the contents. A circular concave element is fixed adjacent its perimeter to a shaft journaled in the cylinder body transverse the through passage and below the side exit, for swinging the circular concave element upwardly to close the through passage and simultaneously engage a "stinger" to trip a bottom valve in the bailer and thereby releasing the contents on and into the circular concave element for channeling to and out of the side exit, and for swinging the circular concave element downwardly to open the through passage for the travel of the pipe bailer up and down the shallow well. A crank is fixed to the shaft and actuated by a hydraulic cylinder controlled by limit switches responsive to bailer travel.

1 Claim, 4 Drawing Figures

BOTTOM VALVE TRIPPING AND LIQUID CHANNELING DEVICE FOR AN AUTOMATED BAILER OF SHALLOW WELLS

BACKGROUND OF THE INVENTION

The invention relates to automated bailers for shallow wells, and more particularly to a bottom valve tripping and fluid channeling device for a pipe bailer used in said automated bailers.

The prior art comprises a U.S. Pat. No. 4,037,662 to Bowling which teaches tripping the bottom valve of a pipe bailer by engaging a valve "stinger" between opposed rollers that are pivoted to separate when biased upward and to close when biased downward. The pipe bailer pivots the rollers apart in its passage upward, the rollers closing around the "stinger" on the beginning of the downward passage to trip the bottom valve and release the liquid contents of the bailer to fall over the rollers and into a concentric hole in a storage tank. Unless the tower of Bowling was cased, the contents were released into ambient conditions of weather and environment affecting both viscosity and purity of the released contents, which also lubricated the rollers and stinger to reduce the frictional engagement therebetween to inoperability. The invention corrects these disabilities.

SUMMARY OF THE INVENTION

An object of the invention is to provide a combination bottom valve tripping and liquid channeling device for a pipe bailer that is fully enclosed and operational under all ambient conditions.

DETAILED DESCRIPTION OF THE INVENTION

Figure 1:
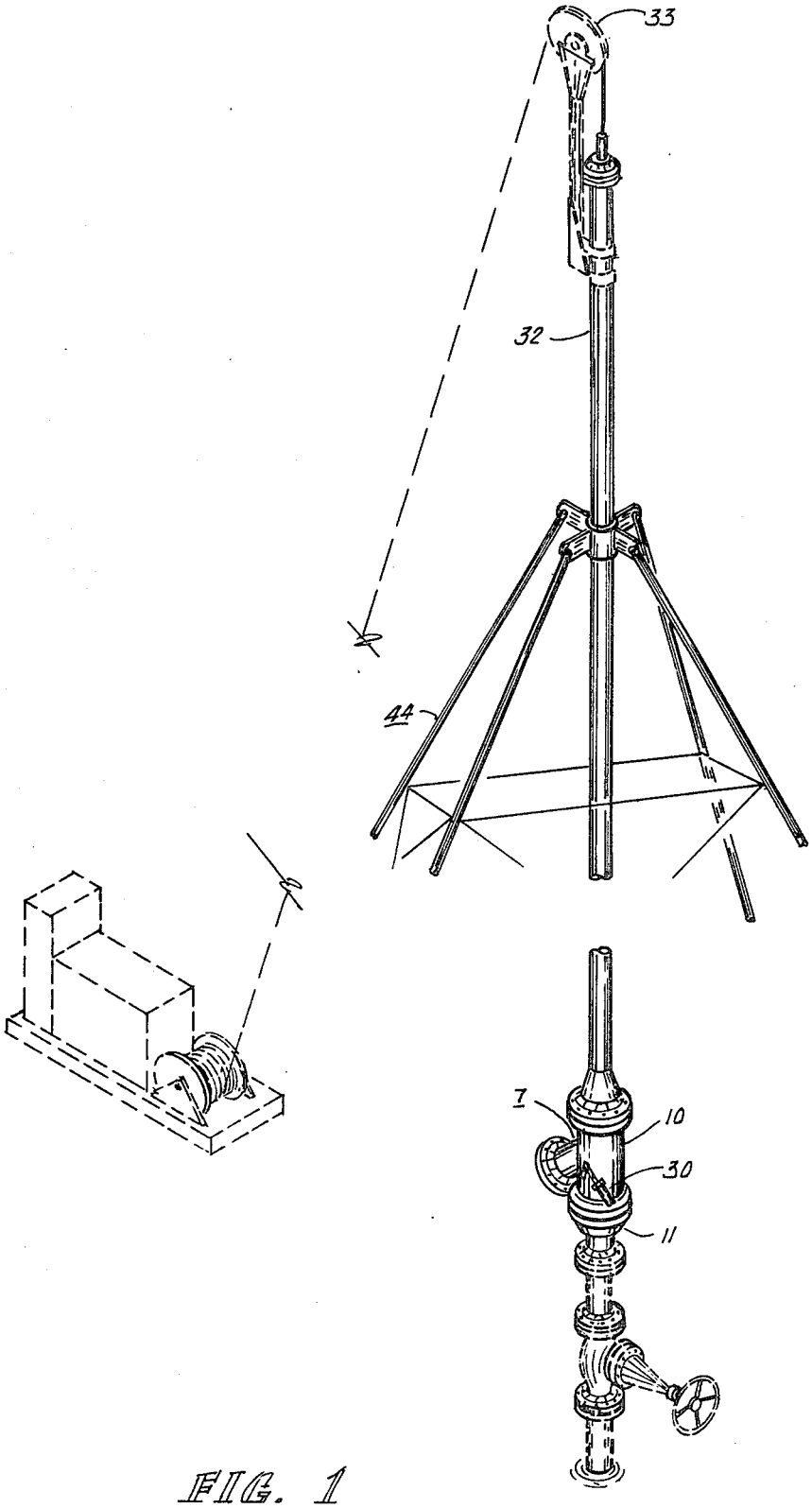
FIG. 1 is a three dimensional drawing, partially diagrammatic, of the invention in operable position.

Referring to FIG. 1, the invention comprises a bottom valve tripping and liquid channeling device 7 for use in tripping a bottom valve 8 of a pipe bailer 9 for the release of the contents and the channeling thereof out of the device 7.

Figure 2:
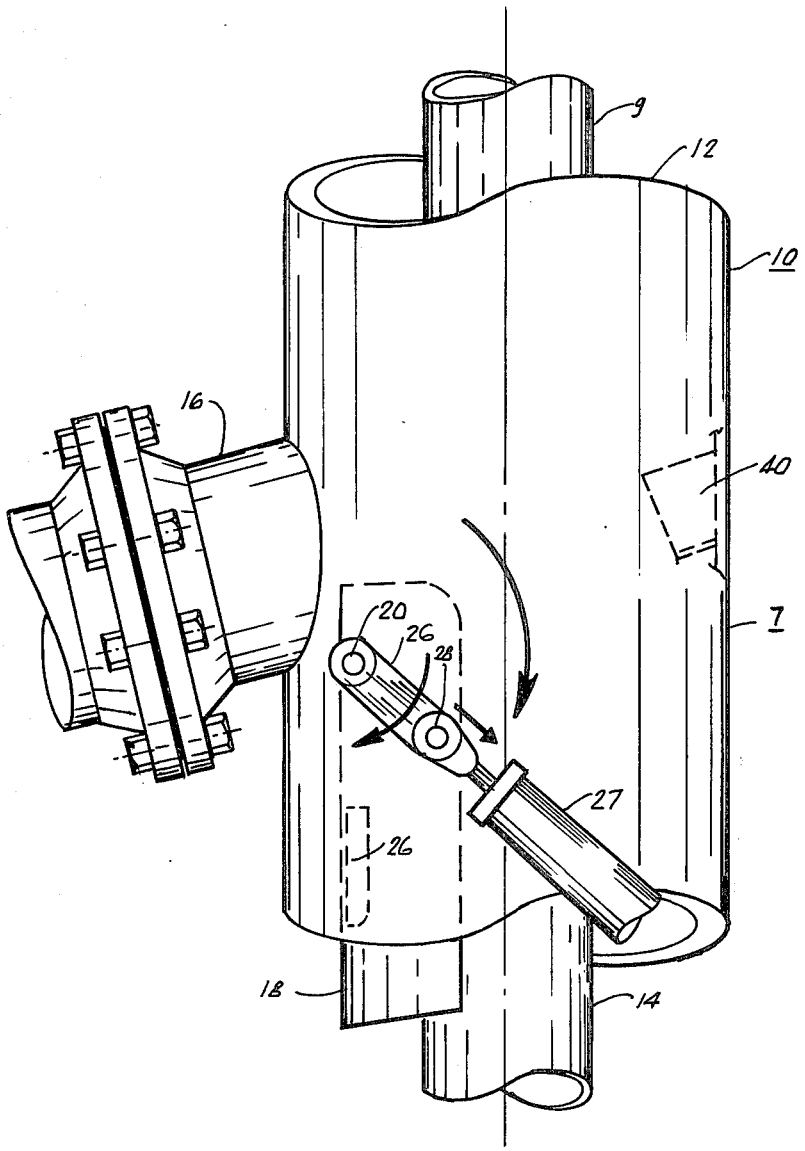
FIG. 2 is a three dimensional side elevation, enlarged to show detail, of the invention in open passage non-tripping position.
Figure 3:
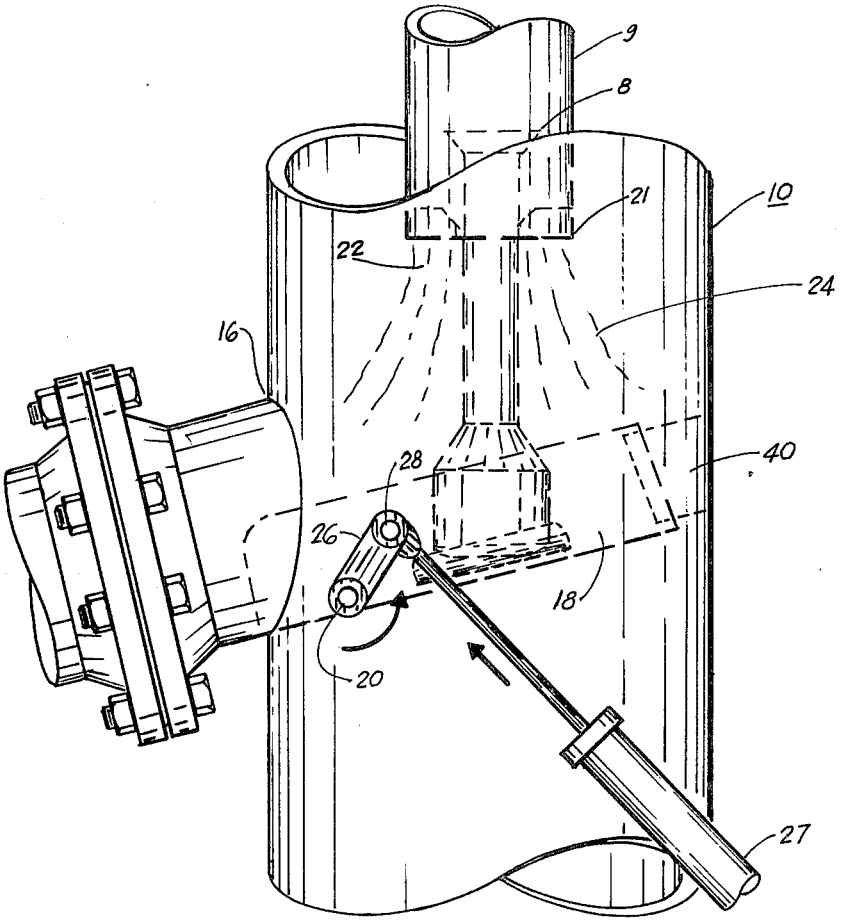
FIG. 3 is similar to FIG. 2 but in closed passage tripping position.
Figure 4:
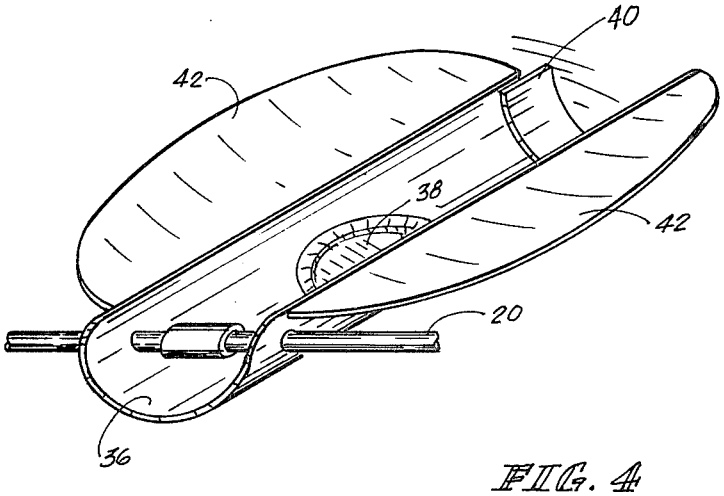
FIG. 4 is a three dimensional view from the top right of a movable part of the invention.

Referring to FIGS. 2–4, device 7 comprises a cylindrical body 10 vertically mounted on a production casing 11 of a shallow well not shown. Body 10 defines a through passage 12 for pipe bailer 9 and a side exit 16 for the liquid contents thereof. A circular concave element 18 is fixed to a shaft 20 that is journaled in body 10 to extend transversely across passage 12 below exit 16. Element 18 is rotatable by shaft 20 from a vertical hanging position below exit 16 and clear of bailer 9 as it passes in passage 12 to a transverse position across said passage and inclined downward through exit 16 and below a lower end 21 of pipe bailer 9 at its highest position. In rotating upward in passage 12, element 18 engages a depending "stinger" 22 fixed to bottom valve 8 to push it upward, opening valve and releasing bailer liquid contents as indicated by flow lines 24 on and into element 18 and out exit 16. A crank shaft 26 is fixed to an exterior end of shaft 20 for the rotation thereof by a hydraulic cylinder 27 pivoted to and between crank end 28 and a collar 30 fixed to sleeve 11.

Referring specifically to FIG. 4, circular concave element 18 comprises a channeled member 36 that defines a liquid flow path and in the bottom of which a blind recess 38 is defined for receiving and engaging the lower end of stinger 22 to support it against the transverse flow of liquid and possible jamming thereby. A channel stop 40 is fixed to body 10 in passage 12 to extend inward and engage channel member 36 limiting the rise of element 18 to alignment with a downward declining outlet fixture 41 fixed to exit 16. Channel stop 40 also prevents any back flow up member 36 from running back down into the well via production casing 11. Sphere segments 42 are fixed to opposite sides of channel member 36 to extend radially outward just short of periphery of passage 12 unengaged by the oppositely disposed ends of member 36 thereby closing passage 12 for all practical purposes when element 18 is pivoted to transverse position, and opening passage 12 when element 18 is pivoted downward.

A tower sleeve 32 is braced by an assembly of structural parts 44 and supports a crown block 46, hoisting line 48, and limit switches (not shown) that are actuated by bailer 9 as it is raised and lowered to energize hydraulic cylinder 27 and swing element 18 upwardly as lower end 21 of bailer 9 travels upward, and to swing element 18 downward as bailer 9 is lowered, as explained in the Bowling patent mentioned heretofore.

What is claimed is:

1. In an automated bailer having a pipe bailer with a bottom valve and attached stinger, a bottom valve tripping and liquid channeling device comprising:

(a) a cylindrical body means mounted on the top of a shallow well production casing and defining a longitudinal passage for said pipe bailer in and out of said well and a side exit for the discharge of bailed liquid;

(b) a channeled member pivotally mounted in the longitudinal passage of said cylindrical body and below said side exit, and adapted to pivot upward from a depending vertical position adjacent periphery of said passage to a transverse position lifting said stinger to trip said bottom valve for discharging the bailed liquid in said pipe bailer above said channeled member, said channeled member defining a blind recess for receiving and thereby stabilizing said stinger against displacement by the flow of bailed liquid and adapted to extend diametrically across said longitudinal passage;

(c) a pair of spherical segments respectively fixed to opposite sides of said channeled member to extend radially outward for substantially closing said longitudinal passage when said channeled member is in its transverse position; and (d) power actuated mechanical means for pivoting said channeled member and attached spherical segments between said vertical position clear of the passing pipe bailer and its transverse position substantially closing said passage for catching and channeling the flow of discharged liquid of said pipe bailer to and through said side exit.

* * * * *